US005228847A

United States Patent [19]

Lywood et al.

[11] Patent Number: 5,228,847

[45] Date of Patent: Jul. 20, 1993

[54] CATALYTIC COMBUSTION PROCESS

[75] Inventors: Warwick J. Lywood, Cleveland; Martin Fowles, North Yorkshire; David G. Shipley, Stockton on Tees, all of England

[73] Assignee: Imperial Chemical Industries plc, London, England

[21] Appl. No.: 808,803

[22] Filed: Dec. 18, 1991

[30] Foreign Application Priority Data

Dec. 18, 1990 [GB] United Kingdom ..... 9027331

[51] Int. Cl.[5] ..... F23D 3/40

[52] U.S. Cl. ..... 431/7; 431/11; 431/268; 60/39.822

[58] Field of Search ..... 431/7, 11, 12, 326, 431/268; 60/39.822; 422/171, 190, 194, 199

[56] References Cited

U.S. PATENT DOCUMENTS

| | | | |
|---|---|---|---|
| 2,941,361 | 6/1960 | Spalding . | |
| 3,928,961 | 12/1975 | Pfefferle | 431/7 X |
| 3,940,923 | 3/1976 | Pfefferle . | |
| 4,047,877 | 9/1977 | Flanagan | 60/39.06 |
| 4,065,917 | 1/1978 | Pfefferle | 60/39.02 X |
| 4,072,007 | 2/1978 | Sanday . | |
| 4,089,654 | 5/1978 | Polinski et al. . | |
| 4,154,568 | 5/1979 | Kendall et al. . | |
| 4,197,700 | 4/1980 | Jahnig | 60/39.06 X |
| 4,354,821 | 10/1982 | Kesseting et al. | 431/7 |
| 4,375,949 | 3/1983 | Solooja | 431/7 |
| 4,459,126 | 7/1984 | Krill et al. | 431/7 |
| 4,521,532 | 6/1985 | Cho . | |
| 4,534,165 | 8/1985 | Davis, Jr. et al. . | |
| 4,726,181 | 2/1988 | Pillsbury . | |
| 4,870,824 | 10/1989 | Young et al. . | |
| 4,926,645 | 5/1990 | Iwai et al. . | |
| 5,048,284 | 9/1991 | Lywood et al. | 60/39.02 |

FOREIGN PATENT DOCUMENTS

| | | |
|---|---|---|
| 58-49817 | 3/1983 | Japan . |
| 58-108332 | 6/1983 | Japan . |
| 58-140511 | 8/1983 | Japan . |
| 59-109704 | 6/1984 | Japan . |
| 59-180219 | 10/1984 | Japan . |
| 59-180220 | 10/1984 | Japan . |
| 1460312 | 1/1977 | United Kingdom . |
| 2184226 | 6/1987 | United Kingdom . |

OTHER PUBLICATIONS

Touchton et al., "Design of a Catalytic Combustor for Heavy-Duty Gas Turbines," Journal of Engineering for Power, vol. 105, Oct. 1983, pp. 797-805.

*Primary Examiner*—Larry Jones

*Attorney, Agent, or Firm*—Cushman, Darby & Cushman

[57] ABSTRACT

A combustion process, e.g. for a gas turbine, comprises catalytically combusting part of a fuel/air feed in a preliminary catalyst body which has through passages and supports, or is composed of, a catalyst active for the combustion of the fuel. The resultant heated gas stream is then mixed with the remainder of the feed, and that mixture is combusted, e.g. catalytically in a main catalyst body. The amount of combustion occurring in the preliminary catalyst body is sufficient that combustion of the mixture of the heated gas stream and the remainder of the feed can be sustained at the desired operating conditions. Under those desired operating conditions combustion of the feed could not be sustained in the absence of the heating given by the combustion in the preliminary catalyst body. There may be more than one preliminary catalyst body. The preliminary catalyst body or bodies may also be provided with passages wherein combustion does not take place under the desired operating conditions so that those passages act as a bypass. Preferably the combustion passages of at least the first preliminary catalyst body are of such size, that at the normal operating conditions, the flow therethrough is laminar, whereas the flow through the passages of the main catalyst body, where employed, is turbulent.

11 Claims, 2 Drawing Sheets

CATALYTIC COMBUSTION PROCESS

BACKGROUND OF THE INVENTION

This invention relates to catalytic combustion and in particular to a catalyst structure for use in a catalytic combustion process, for example as encountered in gas turbines.

Catalyst bodies for use in such processes may comprise a structure, such as a foam or honeycomb, having through passages supporting, or composed of, a catalyst active for the combustion process. In any combustion process there may be used an assembly of one or more such catalyst bodies. In a catalytic combustion process a combustible mixture of a gaseous fuel and a combustion-supporting gas, e.g. air, at a temperature below that at which autoignition takes place is fed, normally at superatmospheric pressure, typically in the range 2 to 40 bar abs., to the catalyst body assembly wherein combustion takes place giving a hot gas stream. The fuel may be gaseous or liquid at ambient pressure and temperature, but most, if not all, of the fuel should be in the gaseous state at the temperature and pressure at which the combustible mixture is fed to the catalyst body. Examples of suitable fuels include natural gas, propane, naphtha, kerosene, and diesel distillate. At least part of the fuel may be the product of subjecting a hydrocarbon feedstock to catalytic autothermal steam reforming. A process describing the use of catalytic autothermal steam reforming of a hydrocarbon feedstock to produce a gas turbine feedstock is set out in EP 351094.

Touchton et al describe, in the "Journal of Engineering for Power" (Transactions of the ASME) 105 October 1983 pages 797–805, particularly page 799, an assembly of a series of honeycomb catalyst bodies in series wherein the cell density, i.e. number of cells per unit cross section, of the assembly increases in the direction of gas flow therethrough. Thus the honeycomb catalyst bodies of the first two sections of the assembly have 16 and 64 cells per square inch (2.5 and 9.9 cells per $cm^2$) respectively, while the subsequent sections of the assembly have 100 cells per square inch (15.5 cells per $cm^2$). This arrangement is though to give more complete catalytic combustion over a range of gas velocities than an arrangement wherein the cell density is the same throughout the length of the assembly. While this arrangement may be satisfactory at relatively low gas velocities, wherein the gas flow through the passages of the catalyst body is laminar, there is some doubt that the use of such a "graded cell" construction is effective at the higher gas velocities encountered in gas turbines wherein the flow through the passages may be turbulent.

Catalytic combustion processes such as those encountered in gas turbine applications are normally operated, at least once the catalyst has "lit-off", at very high gas velocities and this presents problems in maintaining combustion. Typical linear gas velocities through the catalyst body passages during normal operation are in the range 25–150, particularly 50–100, $m.s^{-1}$. As the flow rate is increased, the rate at which heat is lost from the catalyst surface to the gas increases. The rate at which fuel is transferred to the catalyst surface also increases as the gas velocity increases. Provided the catalyst is of sufficient activity to burn the fuel, the rate at which heat is released at the catalyst surfaces thus increases as the gas velocity increases. Thus, provided the catalyst is of sufficient activity, the rate of heat release and the rate of heat loss both increase as the gas velocity increases and so the catalyst surface temperature changes little, if at all. As the gas velocity is increased further, eventually a flow rate is reached where the reaction rate cannot be increased and becomes kinetically limited. Further increase in the flow rate increases the heat loss and so the temperature of the catalyst surface falls. This reduces the rate of combustion on the catalyst surface, which results in a further fall in temperature, until a point is reached where combustion can no longer be sustained. The temperature at which combustion can no longer be sustained depends on a variety of factors such as the nature and concentration of the fuel in the combustible mixture, the gas velocity, and the nature and activity of the catalyst. [The switch from mass transfer to kinetic control is not as sharp as might be implied from the above; the net effect is always the sum of the limitations imposed by the mass transfer and the reaction rate].

Available catalysts that are able to tolerate the temperatures normally achieved unfortunately have insufficient activity to enable operation at the gas flow rates normally desired in gas turbine operations; i.e. the desired flow rates are greater than those at which combustion can be sustained. In some cases catalysts that can tolerate the temperatures normally achieved have insufficient activity to enable the catalyst to "light-off", or effect complete conversion, at acceptable preheat temperatures. While there are some catalysts with sufficiently high activity to perform the combustion at lower temperatures, these active catalysts tend to sinter and/or evaporate at the temperatures normally achieved and so the catalyst life is limited.

These problems can be overcome to some extent by increasing the temperature at which the combustible mixture is fed to the combustion apparatus. Thus if the feed temperature is sufficiently high it may be possible to sustain combustion even at high gas flow rates. However it is often not practical to supply the combustible mixture at a high enough temperature. For example it is usually desired to supply the combustible mixture to the combustion apparatus at a temperature in the range 250°–450° C., particularly 300°–400° C. corresponding to the delivery temperature of the compressor producing the pressurised combustible mixture.

It has been proposed in U.S. Pat. No. 4,089,654 to employ an assembly of a series of honeycomb units bearing catalysts of differing activity with the upstream units having a catalyst of greater activity than that of downstream units. In this way the high activity catalyst effects some combustion thus giving a gas stream that is at a sufficiently high temperature that combustion will be sustained when that gas is fed to a subsequent lower activity catalyst that can withstand the normal operating temperature. In that reference, to avoid overheating of the high activity catalyst, provision was made to avoid "line-of-sight" radiation paths from downstream to upstream. For example one unit in the form of a blank disc with a surrounding annulus of the honeycomb catalyst is followed by a second unit of the opposite configuration, viz a central honeycomb catalyst having a surrounding blank annular region.

SUMMARY OF THE INVENTION

We have devised an alternative solution to the problem of maintaining combustion at high flow rates with a feed temperature that is below that necessary to sustain combustion at that flow rate. In the present invention, the use of such high activity catalysts is not necessary, although they may be employed if desired.

In the present invention combustion is sustained by providing, in the initial part of the combustion apparatus, catalyst body regions through which the flow of part of the feed is sufficiently low, preferably laminar, that combustion of that part of the feed is sustained at the desired feed temperature: this is achieved by providing the initial part of the catalyst body assembly with passages of such size, e.g. hydraulic diameter and length, that the linear gas velocity therethrough is sufficiently low, preferably laminar, that combustion of that part of the feed is sustained, while the remainder of the feed bypasses those passages. [By the term "hydraulic diameter" we mean 4 times the area of the passage cross section divided by the perimeter of the passage cross section. It is seen that in the case of passages of a circular or regular polygonal cross section, the hydraulic diameter equals the diameter of the inscribed circle].

It has been proposed in GB 2184226 and U.S. Pat. No. 4,521,532 to provide a honeycomb structure combustion catalyst wherein, for at least the inlet part of the honeycomb structure, some of the passages had a smaller cross section than the remaining passages, e.g. by subdividing some of the passages for at least the inlet part of their length. The rationale of these references was that combustion would take place earlier in the passages of smaller cross section and heat would be transferred through the walls of the honeycomb to the gas in adjacent passages to assist the combustion in those adjacent passages.

Thus in the present invention part of the combustible mixture is passed through passages of such size that combustion of that part of the feed is sustained and combusted therein to give a heated gas stream which is then mixed with the remainder of the combustible mixture that has bypassed that area: this has the effect of providing a heated combustible mixture. Provided the temperature of the heated combustible mixture is sufficient, combustion of that heated combustible mixture can be sustained. The combustion of the heated combustible mixture is preferably effected catalytically by passing the heated combustible mixture through the passages of a further catalyst body. However, in some cases it may be possible to arrange that the heated combustible mixture given by the mixing of the heated gas stream with the remainder of the combustible mixture may be hot enough that homogeneous, i.e. gas phase, combustion of the heated combustible mixture occurs so that a catalyst for the combustion of the heated gas mixture is unnecessary. However, even in that situation it is preferred to pass the heated combustible mixture through passages of a further catalyst body so that some combustion occurs therein: in this way the carbon monoxide and/or hydrocarbons content of the combusted heated combustible mixture can be kept to an acceptable level.

A combustion catalyst assembly employing a plurality of honeycomb structures through which the gas successively flows, with mixing regions between each structure, is described in U.S. Pat. No. 4,072,007.

Accordingly the present invention provides a process for the catalytic combustion of a combustible gaseous mixture of a fuel and a combustion-supporting gas wherein said combustible mixture is fed at an elevated feed temperature to combustion apparatus, said process comprising a) passing a first part of said combustible mixture through passages of at least one preliminary catalyst body in said combustion apparatus, said passages through which said first part passes supporting, or composed of, a catalyst for the combustion of said combustible mixture, and being of such size, in relation to the linear gas velocity therethrough, that at said elevated feed temperature, catalytic combustion of said first part of said combustible mixture is sustained in those passages, thereby giving at least one heated gas stream, b) mixing said at least one heated gas stream with the remainder of said combustible mixture to give a heated combustible mixture at a temperature above that at which combustion of said heated combustible mixture can be sustained, and thereafter c) combusting said heated combustible mixture, said combustible mixture being fed to said combustion apparatus at a total mass flow rate greater than that at which combustion would be sustained with the feed of said combustible mixture at said elevated feed temperature in the absence of the combustion occurring in said at least one preliminary catalyst body.

It will be appreciated that when operating the combustion apparatus at low throughputs, e.g. throughputs below its maximum design rate, the problems of combustion not being sustained with the feed at the elevated temperature in the absence of the combustion of part of the combustible mixture in the preliminary catalyst body may not arise.

As explained below, in preferred forms of the invention, there may be more than one preliminary catalyst body having passages wherein combustion takes place with part of the combustible mixture bypassing those passages. For convenience the passages wherein combustion is sustained are hereinafter termed combustion passages while any passages through which combustible mixture passes but in which combustion is not sustained are hereinafter termed bypass passages. Where at least part of the combustion of the heated combustible mixture is effected catalytically, for convenience the catalyst body, or bodies, wherein that catalytic combustion of the heated combustible mixture is effected, is herein termed the main catalyst body.

In the present invention there is thus employed one or more preliminary catalyst bodies. The preliminary catalyst body, or at least the first catalyst body where there are two or more preliminary catalyst bodies, may have passages all of such size that they constitute combustion passages: in this case part of the combustible mixture is fed through that preliminary catalyst body and the remainder bypasses that preliminary catalyst body. Alternatively the preliminary catalyst body, or bodies, may have passages of different sizes, e.g. different hydraulic diameters and/or lengths, such that combustion is sustained in some passages but not in passages of a different size. For example the flow through some passages may be laminar while flow through others is turbulent. In this case, part, or all, of the combustible mixture is passed through the, or each, preliminary catalyst body, but part of the combustible mixture flows through bypass passages. Such passages acting as a bypass may be free from catalyst.

The catalyst body may be in the form of a foam structure, but preferably is of honeycomb construction. Where a main catalyst body is employed wherein at least part of the combustion of the heated combustible mixture takes place, the hydraulic diameters and/or lengths of the combustion passages of the preliminary catalyst body or bodies may differ from those of the passages of the main catalyst body.

The catalysts employed, and the size of the preliminary catalyst body or bodies, should be such as to ensure that, at the design maximum flow rate and feed temperature, sufficient combustion occurs in the preliminary catalyst body, or bodies, that the heated combustible mixture formed by mixing the heated gas stream, or streams with the remainder of the combustible material has a temperature high enough that combustion of that heated combustible mixture will be sustained.

Combustion is usually initiated by feeding the combustible mixture at a relatively low flow rate and at an elevated temperature, which may be higher than the elevated feed temperature employed during normal operation, to the combustion apparatus: when "light-off" of the catalyst in at least the preliminary catalyst body, or bodies, has been achieved, the flow rate can be increased and the feed temperature adjusted, if necessary, to the normal operating conditions. An increased initial feed temperature may be achieved by means of a suitable preheater, e.g. pilot burner. This initial additional preheating may be discontinued after "light-off" or continued throughout normal operation. However it will be appreciated that, at the increased flow rates of normal operation, this additional preheating may have negligible effect on the operation. The catalysts and size of the preliminary catalyst body should therefore also be such that initiation of catalytic combustion in the combustion passages of the preliminary catalyst body, or bodies, occurs at acceptable initial feed conditions.

Catalysts that may be employed typically comprise a wash coat containing a rare earth such as ceria on a primary support of e.g. alumina or mullite. Particularly suitable catalysts comprise mixtures of certain oxides, especially certain mixtures of rare earth oxides e.g. ceria, praseodymia and lanthana, or precious metals such as palladium.

In order to achieve a sufficiently hot heated combustible mixture, it may be desirable to employ more than one preliminary catalyst body having combustion passages, with part of the combustible mixture passing, preferably in laminar flow, through combustion passages of a first preliminary catalyst body, and another part of the combustible mixture passing, preferably in laminar flow, through combustion passages of a second preliminary catalyst body. The preliminary catalyst bodies are thus effectively operating in parallel. It will be appreciated that there may be more than two such preliminary catalyst bodies.

In another form of the invention part of the combustible mixture is combusted in combustion passages of one or more preliminary catalyst bodies and then is mixed with a further portion of the combustible mixture to produce a mixture that can sustain combustion in combustion passages of a further preliminary catalyst body. The feed to those combustion passages of the further preliminary catalyst body thus is a mixture of hot combusted gas from the passages of the upstream preliminary catalyst body or bodies and fresh combustible mixture. There may be a series of such further preliminary catalyst bodies, with the feed to the second, and any subsequent, further preliminary catalyst bodies being a mixture of fresh combustible mixture with hot combusted gas from the upstream further catalyst body. The effluent from the last further preliminary catalyst body is then mixed with the remainder of the combustible mixture to give the heated combustible mixture which is then combusted, preferably catalytically. In this embodiment the flow through the combustion passages of the further preliminary catalyst body or bodies, and main catalyst body, if used, may be laminar or, preferably, turbulent.

As mentioned above, in one form of the invention, the, or each, preliminary catalyst body may be constructed with combustion passages of such size, e.g. relatively small hydraulic diameter and/or relatively long, that combustion can be sustained therein, and also bypass passages of such size, e.g. having a relatively large hydraulic diameter and/or being relatively short, that essentially no combustion takes place therein. Where a catalyst body has passages of different sizes, it will be appreciated that whether any passage is a combustion passage or a bypass passage will depend on the relative numbers and sizes of the passages, coupled with the overall flow rate through that catalyst body, the temperature of the feed to those passages, and the activity of the catalyst. It will be appreciated that at low flow rates, combustion may occur in some passages which become bypass passages at high flow rates. Consequently the relative numbers and sizes of the passages in each preliminary catalyst body should be selected that, at the desired operational flow rates, there is sufficient combustion.

The proportion of the combustible mixture combusted in the preliminary catalyst body, or bodies, is such that, when mixed with the remainder of the combustible mixture, the resultant heated combustible mixture is hot enough that combustion thereof can be sustained, e.g. in a main catalyst body, despite the fact that at the desired operational flow rate, the temperature of the feed to the combustion apparatus is insufficient to sustain combustion, e.g. in the main catalyst body, in the absence of the combustion occurring in the preliminary catalyst body or bodies.

Where a preliminary catalyst body has bypass passages for supplying part of the combustible mixture to a downstream zone, the combustion passages of that preliminary catalyst body may be disposed across the cross section of the catalyst body in clusters of sufficient number such that substantial heat loss to adjacent bypass passages is avoided. For example, where the preliminary catalyst body has an overall circular cross section, such clusters may be arranged radially or in groups disposed symmetrically around the centre. Alternatively the combustion passages may be disposed in one or more particular areas, e.g. as a central region or as an outer annulus.

In embodiments wherein there is more than one preliminary catalyst body having combustion passages, these preliminary catalyst bodies may be disposed in series with their combustion passages disposed such that the hot combusted gas from the combustion passages of the first preliminary catalyst body bypasses the combustion passages of the second preliminary catalyst body whereby the part of the combustible mixture fed to the combustion passages of said second preliminary catalyst body is essentially uncombusted combustible mixture.

In an alternative form of the invention, the, or each, preliminary catalyst body each have only combustion passages and separate bypass conduits are provided to supply part of the combustible mixture to the zone, or zones, downstream thereof.

BRIEF DESCRIPTION OF THE DRAWINGS

Four embodiments of the invention will now be described by way of example and with reference to the accompanying drawings wherein.

DESCRIPTION OF THE PREFERRED EMBODIMENTS

Figure 1:
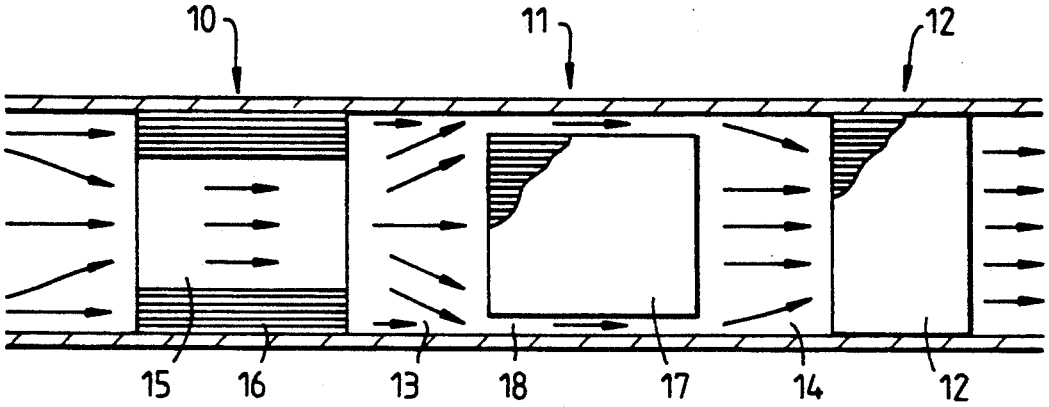
FIG. 1 is a diagrammatic representation of a first embodiment having an assembly of three catalyst bodies and showing the gas flow therethrough.
Figure 2:
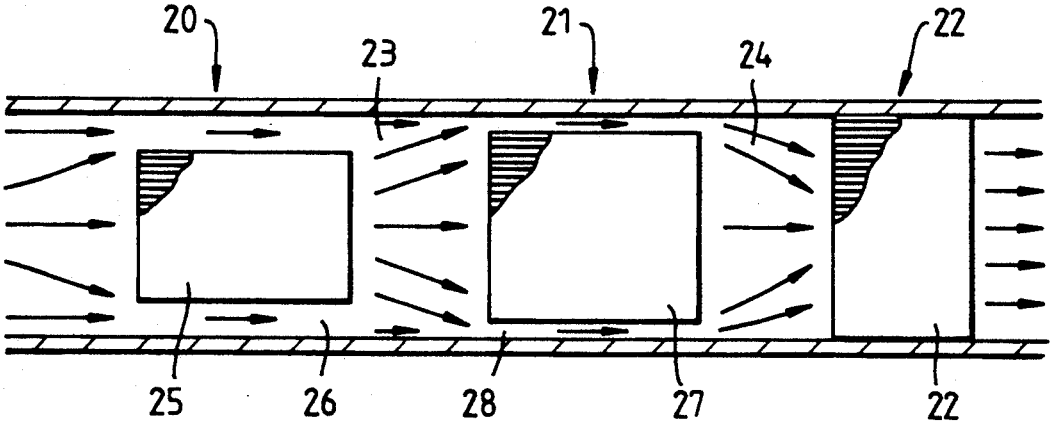
FIGS. 2 to 4 are views similar to FIG. 1 showing second, third, and fourth embodiments.

In the embodiment of FIG. 1 the catalyst assembly consists of a series of first and second preliminary catalyst bodies 10 and 11 respectively and a main catalyst body 12 with zones 13, 14, between the bodies. Each of the catalyst bodies has the same overall cross sectional area. The first catalyst body 10 has a central hole 15 constituting 23% of the total cross sectional area of the body 10 surrounded by an annular region 16 of a honeycomb configuration having a voidage of 70% provided by through passages of hydraulic diameter 0.7 mm. The length of the first catalyst body 10 to 15 cm.

The second catalyst body 11 also has a length of 15 cm but has a configuration that is the inverse to the first catalyst body 10, viz a central region 17 having a honeycomb configuration of voidage 70% provided by through passages of hydraulic diameter 0.7 mm supported by webs thus providing an outer annular region 18 of essentially 100% voidage. The outer annular region 18 forms about 32% of the total cross section area.

The main catalyst body 12 has a length of 10 cm and has a honeycomb configuration of 70% voidage provided by through passages of hydraulic diameter 1.4 mm all over its cross section. Each catalyst body honeycomb comprises a ceria-containing combustion catalyst composition on a ceramic honeycomb support.

At start-up the fuel gas/air mixture is fed to the catalyst assembly at a temperature sufficient that "light-off" will be achieved. After "light-off", the inlet temperature can be reduced to the normal running inlet temperature, which may typically be of the order of 300° C.

It is calculated that if, in normal running, a fuel gas/air mixture at 300° C., of such composition that combustion of the fuel gives a gas mixture at 1200° C., is fed at 10 bar abs. and at a design rate of 100 $kg.s^{-1}$ (per $m^2$ of the total catalyst body cross section) to the first catalyst body 10, about 31% of the mixture flows in laminar fashion through the passages of the annular region 16 and combusts therein producing a hot gas stream emerging into zone 13 at about 1200° C., while the remaining 69% passes in turbulent manner through the central hole 15 into the zone 13 without combusting.

The gas then enters the second catalyst body 11. The respective areas of the central region 17 and annular region 18 of the second catalyst body 11 are such that about 27% of the gas mass flows through the honeycomb central region 17 in a laminar fashion and combusts therein, emerging into zone 14 at about 1200° C., while the remaining 73% passes through the annular region 18. It is assumed that in zone 13 little mixing takes place between the combusted gas from the annular region 16 of the first catalyst body 10 with the uncombusted gas from the central hole 15 of catalyst body 10. As a result the gas entering the central region 17 of the second catalyst body 11 is essentially fresh fuel gas/air mixture at 300° C. that has passed, uncombusted, through central hole 15 of catalyst body 10. It is likewise assumed that the gas passing through the annular region 18 of catalyst body 11 is a mixture of the combusted gas from annular region 16 of catalyst body 10 together with the remainder of the fresh fuel gas/air mixture. It is calculated that this mixture of gas passing through the annular region 18 of catalyst body 11 will have an average temperature of about 680° C. In zone 14 the gas from annular region 18 is mixed with the gas emerging from the central region 17 of catalyst body 11, to give a gas mixture at about 822° C. which then enters the main catalyst body 12.

Even though the flow through the passages of main catalyst body 12 is turbulent, the gas mixture entering body 12 has been sufficiently preheated, as a result of the combustion occurring in the honeycomb passages of the preliminary catalyst bodies 10 and 11 and the mixing in zone 14, that combustion of the remaining uncombusted fuel in the feed will take place within the passages of catalyst body 12 giving a stream of hot gas emerging from body 12 at about 1200° C.

If however the preliminary catalyst bodies 10 and 11 were to be omitted, even if catalyst body 12 were to be made larger, combustion would not be sustained in body 12 at the aforesaid feed temperature of 300° C. at the aforesaid flow rate of 100 $kg.s^{-1}$ (per $m^2$ of the catalyst body 12 cross section).

In the second embodiment, again three catalyst bodies are employed, viz a first preliminary catalyst body 20, a second preliminary catalyst body 21, and a main catalyst body 22, with zones 23 and 24 between the catalyst bodies. In this embodiment the catalyst body 20 is 15 cm long and has a central region 25 having a honeycomb configuration of 70% voidage provided by through passages of hydraulic diameter 0.7 mm. The honeycomb region 25 is supported by webs leaving an outer annular region 26 of essentially 100% voidage. The second catalyst body 21 is also 15 cm long and has a central region 27 having a honeycomb configuration of voidage 70% provided by through passages of hydraulic diameter 1.4 mm. The honeycomb region 27 is supported by webs leaving an outer annular region 28 of essentially 100% voidage. In this embodiment the central region 25 of the first catalyst body 20 represents about 73% of the total cross sectional area of the body 20. In the second catalyst body 21, the central region represents about 91% of the total cross sectional area. As in the first embodiment, the main catalyst body 22 has a length of 10 cm and has a honeycomb configuration of 70% voidage provided by through passages of hydraulic diameter 1.4 mm all over its cross section. As in the first embodiment, each catalyst body honeycomb comprises a ceria-containing combustion catalyst composition on a ceramic honeycomb support.

It is calculated that if, in normal running, a fuel gas/air mixture at 300° C., of such composition that combustion of the fuel gives a gas mixture at 1200° C., is fed at 10 bar abs. and at a design rate of 100 $kg.s^{-1}$ (per $m^2$ of the total catalyst body cross section) to the first catalyst body 20, about 26% of the mixture flows in laminar fashion through the passages of the central region 25 and combusts therein producing a hot gas stream emerging into zone 23 at about 1200° C., while the remaining 74% passes in turbulent manner through the annular region 26 into the zone 23 without combusting.

The size of the central region 27 of the second catalyst body 21 is such that about 58% of the gas mass flows through the passages of the central region 27.

Limited mixing is effected in zone 23 so that the gas entering the central region 27 is the hot gas stream from the central region 25 of the first catalyst body 20 together with part of the fresh fuel gas/air mixture that has passed through the annular region 26 of the first catalyst body 20. It is calculated that the temperature of the gas mixture entering the central region 27 is about 700° C. which is hot enough to sustain combustion in the passages of the central region 27 of the second catalyst body 21 even though it flows therethrough in turbulent fashion. The gas emerging from the central region 27 of second catalyst body 21 then mixes, in mixing zone 25, with the remainder of the fuel/air mixture that passes through the annular region 28 of second catalyst body 21 and then is fed to the main catalyst body 22. It is calculated that the temperature of the gas mixture entering the main catalyst body 22 is about 819° C.

As in the first embodiment, if the preliminary catalyst bodies 20 and 21 were to be omitted, even if catalyst body 22 were to be made larger, combustion would not be sustained in body 22 at the aforesaid feed temperature of 300° C. at the aforesaid flow rate of 100 $kg.s^{-1}$ (per $m^2$ of the catalyst body 22 cross section).

In this second embodiment, the zones 23 and 24 between the catalyst bodies enable a diffusion flame between the hot and cold gases to be developed. This can be achieved by controlling the mixing of the hot gas as it leaves the passages of the catalyst body wherein combustion takes place with cold gas that has passed through the annual regions. By maximising the diffusion zone, combustion may occur homogeneously and, as a result, the overall volume of catalyst required may be reduced. Thus in some cases it is possible to omit the main catalyst body 22 or to decrease its size so that it serves merely to decrease the carbon monoxide and/or hydrocarbons content of the effluent to an acceptable level.

Instead of the above described central region/annular region configurations, it will be appreciated that similar results may be achieved by employing the combustion passages of the preliminary catalyst bodies evenly disposed in clusters across the cross-section of the preliminary catalyst bodies. The use of evenly disposed clusters of such passages may assist the promotion of a diffusion zone and/or mixing in the zones between the catalyst bodies.

Figure 3:
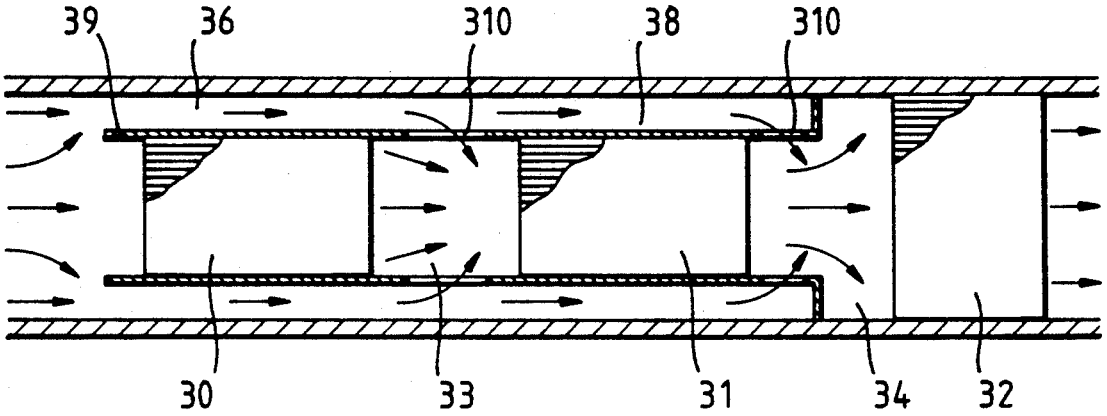

The third embodiment shown in FIG. 3 is similar to the second embodiment except that the bypass passages are formed by an external conduit formed by the annular space between a liner 39 and the exterior shell of the combustion apparatus. The first preliminary catalyst body 30 has all its honeycomb passages the same size and extends across the cross section of the apparatus within liner 39. The second preliminary catalyst body 31 likewise has its passages all the same size and extends across the cross section of the apparatus within liner 39. That part of the annular space between liner 39 and the exterior shell adjacent the first preliminary catalyst body 30 forms a bypass 36 to the first preliminary catalyst body 30 while that part of the annular space between liner 39 and the exterior shell adjacent the second preliminary catalyst body 31 forms a bypass 38 to the catalyst body 31. Slots 310 in the liner 39 adjacent the zones 33 and 34 between the first and second catalyst bodies 30 and 31 and the second catalyst body 31 and the main catalyst body 32 respectively, permit the combustible mixture passing through the bypass passages 36 and 38 to enter those zones 33 and 34. Operation of this third embodiment will be similar to that of the second embodiment.

Figure 4:
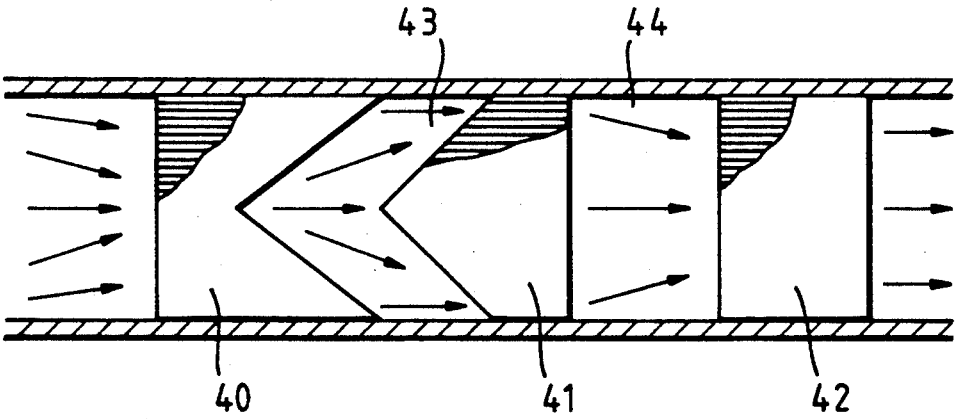

In the fourth embodiment shown in FIG. 4, the first and second preliminary catalyst bodies 40 and 41 are profiled so that there is a gradation in the lengths of the honeycomb passages of those catalyst bodies. Thus the first preliminary catalyst body 40 has short passages at its centre and long passages at its periphery. Conveniently the passages have the same cross section. The shorter passages form bypass passages while the longer passages form combustion passages. The second preliminary catalyst body 41 has the inverse configuration, i.e. short passages adjacent its periphery and longer passages adjacent the centre. The operation of this embodiment is similar to that of the first embodiment but it will be appreciated that there is no sharp distinction between the combustion and bypass passages in the first and second preliminary catalyst bodies 40 and 41. It will further be appreciated that one or the other of the preliminary catalyst bodies 40 and 41 could be omitted if, at the normal operating conditions, sufficient combustion can be effected in the remaining preliminary catalyst body to provide the heated combustible material in zone 44 at a temperature such that combustion thereof can be sustained. Likewise it will be appreciated that the order of the shaped preliminary catalyst bodies 40 and 41 could be transposed, although the arrangement illustrated gives a more compact structure.

We claim:

1. A process for the catalytic combustion of a combustible gaseous mixture of a fuel and a combustion-supporting gas wherein said combustible mixture is fed at an elevated feed temperature to combustion apparatus including at least first and second preliminary catalyst bodies and a main catalyst body, each of which catalyst bodies have combustion passages comprising a catalyst for the combustion of said combustible mixture, said process including the steps of a) feeding, at said elevated feed temperature, a first part of said combustible mixture through said combustion passages of said first preliminary catalyst body which are of such size, in relation to the linear gas velocity therethrough, that catalytic combustion of said first part is sustained therein, thereby giving at least one first heated gas stream, b) feeding, at said elevated feed temperature, a second part of the combustible mixture through said combustion passages of said second preliminary catalyst body which are of such size, in relation to the linear gas velocity therethrough, that catalytic combustion of said second part is sustained therein, thereby giving at least one second heated gas stream, c) mixing said first and second heated gas streams with the remainder of said combustible mixture to give a heated combustible mixture at a temperature above that at which combustion of said heated combustible mixture can be sustained; and thereafter d) combusting said heated combustible mixture, including passing said heated combustible mixture through said combustion passages of said main catalyst body, whereby at least part of the combustion of said heated combustible mixture takes place in said combustion passages of said main catalyst body, said combustible mixture being fed to said combustion apparatus at a total mass flow rate greater than that at which combustion would be sustained with the feed of said combustible mixture at said elevated feed temperature in the absence of the combustion occurring in said combustion passages of said preliminary catalyst bodies.

2. A process according to claim 1 wherein the combustion passages of the main catalyst body are of such size, in relation to the linear velocity of gas passing therethrough, that the flow through those passages is turbulent.

3. A process according to claim 1 wherein the combustion passages of at least the first preliminary catalyst body are of such size, in relation to the linear velocity of gas passing therethrough, that the flow through those combustion passages is laminar.

4. A process according to claim 1 wherein at least the first preliminary catalyst body has, in addition to its combustion passages, at least one bypass passage of such size, in relation to the linear velocity of gas passing therethrough, that combustion is not sustained therein, and the first part, and said second part and/or said remainder of the combustible mixture is fed to said first preliminary catalyst body, whereby said first part of the combustible mixture is combusted in the combustion passages of the first preliminary catalyst body to form said at least one first heated gas stream, while the remainder of said combustible mixture passing through said first preliminary catalyst body passes through said at least one bypass passage.

5. A process according to claim 1 wherein the first and second preliminary catalyst bodies are disposed in series with their combustion passages disposed such that the at least one first heated gas stream from said first preliminary catalyst body bypasses the combustion passages of said second preliminary catalyst body.

6. A process according to claim 1 wherein said first and second preliminary catalyst bodies each have, in addition to their combustion passages, at least one bypass passage of such size, in relation to the linear velocity of gas passing therethrough, that combustion is not sustained, so that a first part of the combustible mixture fed to said first preliminary catalyst body is catalytically combusted in the combustion passages of said first preliminary catalyst body to give said at least one first heated gas stream while the remainder of the combustible mixture fed to the first preliminary catalyst body passes through said at least one bypass passage of said first preliminary catalyst body as at least one bypass stream, and said at least one first heated gas stream, together with said at least one bypass stream and any remainder of said combustible mixture that was not fed to said first preliminary catalyst body, is fed to the second preliminary catalyst body whereby a second part of said combustible mixture is combusted in the combustion passages of the second preliminary catalyst body to give said at least one second heated stream while the remainder of said combustible mixture passes through said at least one bypass passage of said second preliminary catalyst body to form the combustible mixture which is mixed with said heated gas streams.

7. A process for the catalytic combustion of a combustible gaseous mixture of a fuel and a combustion-supporting gas wherein said combustible mixture is fed at an elevated feed temperature to combustion apparatus including at least first and second preliminary catalyst bodies and a main catalyst body, each of which catalyst bodies have combustion passages comprising a catalyst for the combustion of said combustible mixture, said process including the steps of a) feeding, at said elevated feed temperature, a first part of said combustible mixture through said combustion passages of said first preliminary catalyst body, said combustion passages of said first preliminary catalyst body being of such size, in relation to the linear gas velocity therethrough, that catalytic combustion of said first part is sustained therein, thereby giving at least one first heated gas stream;

b) mixing said at least one first heated gas stream with a second part of said combustible mixture, passing the resultant mixture through combustion passages of said second preliminary catalyst body of such size, in relation to the linear gas velocity therethrough, that catalytic combustion of said resultant mixture is sustained in those passages, thereby producing at least one second heated gas stream, and c) mixing said at least one second heated gas stream with the remainder of said combustible mixture to give a heated combustible mixture at a temperature above that at which combustion of said heated combustible mixture can be sustained; and thereafter d) combusting said heated combustible mixture, including passing said heated combustible mixture through said combustion passages of said main catalyst body, whereby at least part of the combustion of said heated combustible mixture takes place in said combustion passages of said main catalyst body, said combustible mixture being fed to said combustion apparatus at a total mass flow rate greater than that at which combustion would be sustained with the feed of said combustible mixture at said elevated feed temperature in the absence of the combustion occurring in said combustion passages of said preliminary catalyst bodies.

8. A process according to claim 7 wherein the second preliminary catalyst body has, in addition to its combustion passages, at least one bypass passage of such size, in relation to the linear velocity of gas passing therethrough, that combustion is not sustained therein, whereby part of the combustible mixture is combusted in said second preliminary catalyst body, while the remainder passes through said at least one bypass passage, said at least one bypass passage of said second preliminary catalyst body being disposed such that the flow therethrough is essentially of uncombusted combustible mixture.

9. A process according to claim 7 wherein the combustion passages of the main catalyst body are of such size, in relation to the linear velocity of gas passing therethrough, that the flow through those passages is turbulent.

10. A process according to claim 7 wherein the combustion passages of at least the first preliminary catalyst body are of such size, in relation to the linear velocity of gas passing therethrough, that the flow through those combustion passages is laminar.

11. A process according to claim 7 wherein at least the first preliminary catalyst body has, in addition to its combustion passages, at least one bypass passage of such size, in relation to the linear velocity of gas passing therethrough, that combustion is not sustained therein, and the first part, and said second part and/or said remainder of the combustible mixture is fed to said first preliminary catalyst body, whereby said first part of the combustible mixture is combusted in the combustion passages of the first preliminary catalyst body to form said at least one first heated gas stream, while the remainder of said combustible mixture passing through said first preliminary catalyst body passes through said at least one bypass passage.

* * * * *